United States Patent [19]

Justus et al.

[11] 4,189,642

[45] Feb. 19, 1980

[54] METHOD AND APPARATUS FOR DRUM CORONA CURRENT MEASUREMENT AND ALIGNMENT

[75] Inventors: Dennis J. Justus, Boulder; Gerald L. Smith, Broomfield, both of Colo.

[73] Assignee: International Business Machines Corporation, Armonk, N.Y.

[21] Appl. No.: 892,707

[22] Filed: Apr. 3, 1978

[51] Int. Cl.[2] ..... H01T 19/04

[52] U.S. Cl. ..... 250/324; 250/315.2

[58] Field of Search ..... 250/324, 315 A

[56] References Cited

U.S. PATENT DOCUMENTS

| | | | |
|---|---|---|---|
| 3,699,388 | 10/1972 | Ukai | 250/324 |
| 3,961,193 | 6/1976 | Hudson | 250/324 |

*Primary Examiner*—Harold A. Dixon

*Attorney, Agent, or Firm*—Pollock, Vande Sande & Priddy

[57] ABSTRACT

Method and apparatus for enabling measurement of corona drum current in an electrostatic copier as a maintenance aid. A rotatable drum supports a photoconductor with a conductive backing connected to a ground current return path including a slip ring. In the maintenance mode, the ground path is opened allowing drum current to flow through a current measuring circuit including a pair of jacks to which a measurement device may be connected. The current measuring circuit also develops a potential which is representative of whether or not the current return path is grounded. This potential is coupled to a monitoring device where it may be used to drive a display. A method of aligning a corona generator employing the corona current measuring apparatus of the invention is applicable for aligning corona generators in situ in an electrostatic copier. The alignment method includes steps of energizing a selected corona generator, interrupting the normal ground return path, providing a current path from the photoconductor and coupling the current path to a measurement device. For alignment purposes, at least two measurements are made, each measurement is made while different portions of the corona generator are masked. The measurements provide a measure of the corona current generated by two different portions of the generator which is useful in aligning the generator.

15 Claims, 3 Drawing Figures

METHOD AND APPARATUS FOR DRUM CORONA CURRENT MEASUREMENT AND ALIGNMENT

FIELD OF THE INVENTION

This invention relates to an apparatus for measuring, in an electrostatic copier, the current generated in a conductive base layer of a photoconductor by a corona generator. The method, employing the apparatus of the invention, is useful in aligning a corona generator in such an electrostatic copier.

BACKGROUND OF THE INVENTION

Conventional electrostatic copiers rely heavily on the ability of a corona generator to charge a photoconductor to a selected potential, and to do so uniformly across the photoconductor. Failure to charge the photoconductor to the desired potential reduces the contrast available in the print. Lack of uniformity in charging across the photoconductor produces degraded prints which have "streaks" or varying contrast.

One form of the conventional corona generator, the so-called scorotron, includes a housing with a plurality of conductive wires located between the housing and the photoconductive layer of the copier. For control purposes, a shield, comprising a further plurality of wires is located between the first group of wires and the photoconductor. The wires and the shield have applied to them selected potentials, see, for example, U.S. Pat. No. 2,777,957. One technique used in the prior art to monitor the operability of a corona generator is to measure the current delivered to the generator by the power supply. The presence of the shield, however, complicates the measurement problem for at least some of the current to the corona generator is drawn off by the shield and does not result in charging the photoconductor.

Another technique is to actually remove the normal photoconductor (usually requiring removal of the photoconductor carrier, i.e., a drum) and substitute a special drum with insulated areas for measurement purposes. The disadvantage of this technique, aside from the drum removal requirement, is the error produced when the normal drum and special drum differ in size or shape. In addition, the substitute drum is typically not rotated and so measurements are made with the machine in a static condition and thus the measurements are poor analogs of actual machine operation which is dynamic.

The most effective technique to monitor the performance of the corona generator is to measure the current flowing between a conductive base layer of the photoconductor and ground. This has been effected by insulating the conductive base layer from ground and employing a current measurement device between the insulated conductive layer and ground; in this regard, see U.S. Pat Nos. 3,950,680; 3,335,274; and 3,335,275.

As mentioned in U.S. Pat. No. 3,950,680, a drawback of this technique is especially evident in multiple corona machines in that conductive layer current is typically not due to a single corona generator. Rather, conventionally, the multiple corona machines have more than one corona energized at a time, and therefore, the current flowing in the conductive layer is the result of more than one corona generator. As a result, the current measurement does not provide an accurate measure of operation of any single one of the corona generators.

Furthermore, measurement of conductive layer current is incapable of indicating corona alignment, even if only a single corona generator is energized.

It is therefore one object of the present invention to provide apparatus for accurate measurement of the proper operation of a corona generator in a multiple corona generator electrostatic copier. It is another object of the invention to provide apparatus of the foregoing type which is capable of monitoring operation of a corona generator without requiring removal of the normal photoconductor and substitution of apparatus therefor. It is a further object of the present invention to provide apparatus of the foregoing type in which a normal ground path for the conductive layer is interrupted for measurement purposes but which provides a signal to the electrostatic copier control unit, indicating whether or not the normal ground path is made.

It is another object of the present invention to provide a method of corona alignment for use with the inventive apparatus.

It is yet another object of the present invention to provide the method of corona alignment which provides for rapid, safe and trouble-free measurement of corona alignment. Another object of the present invention is to provide a dynamic method of measuring corona drum current where the photoconductor potential is similar to normal operating conditions and does not saturate as it would if the drum were not rotating.

SUMMARY OF THE INVENTION

The present invention meets these and other objects of the invention by providing apparatus for dynamic measurement of corona operation in an electrostatic copier unit which includes multiple corona generators. In accordance with the invention, a rotatable drum carries a photoconductor supported on a conductive base layer. In one embodiment, during normal operation, the conductive layer is coupled to a ground return path through slip rings on the drum. In this embodiment, the drum is insulated from ground through its bearings with, for example, insulated bearings. A current measuring circuit is coupled to the ground return path and provides, at a pair of output taps, a voltage related to conductive layer current. A measurement device, coupled to the output taps, will read a voltage related to conductive layer current when the normal ground return path is open. In order to effectively monitor the operation of a single corona generator, in an electrostatic copier, which includes multiple corona generators which may be simultaneously energized during normal operation, control apparatus is provided to enable energization of a single corona generator. The current measurement apparatus also includes a detecting means coupled to the ground return path providing a potential indicating whether or not the normal ground return path is made. The potential is coupled to the control unit for the electrostatic copier which is enabled to drive a display to indicate whether or not the normal ground return path is made.

A method of corona alignment is also provided for use with the inventive apparatus. In accordance with the inventive method, the control unit is enabled to energize a single corona generator and the normal ground return path is interrupted. When interrupted, the measurement apparatus carries current related to conductive layer current which provides a voltage at the output path representative of the conductive layer current. At the same time, the control device turns on the drive motor to rotate the drum during the measurement. It also turns on the erase lamp to discharge the photoconductor, and turns on the magnetic brush bias voltage to avoid the development of toner onto the drum by the developer. Corona alignment is determined by first masking a given area of the corona generator and noting the magnitude of conductive layer current as indicated on the measurement device coupled to the output taps. When this measurement is concluded, a different area (which may be equal to the first area) of the corona generator is masked and a second measurement is made. Alignment is determined by the relationship between the conductive layer current during the two measurements.

Alternatively, the drum can be grounded through its bearings, and the use of the slip rings for this purpose eliminated, if the ground return path through the bearings can be interrupted to divert drum current to the measuring circuit.

BRIEF DESCRIPTION OF THE DRAWINGS

The present invention will now be further described in the further portions of the specification when taken in conjunction with the attached drawings in which.

DETAILED DESCRIPTION OF THE INVENTION

The present invention is adapted for use with conventional electrostatic copiers which operate to reproduce an optical image in electrically charged areas on a photoconductor, and in which such image is transferred to a carrier such as uncoated paper by attracting toner in accordance with the charge on the photoconductor and then transferring the toner to the carrier to reproduce the image.

Figure 1:
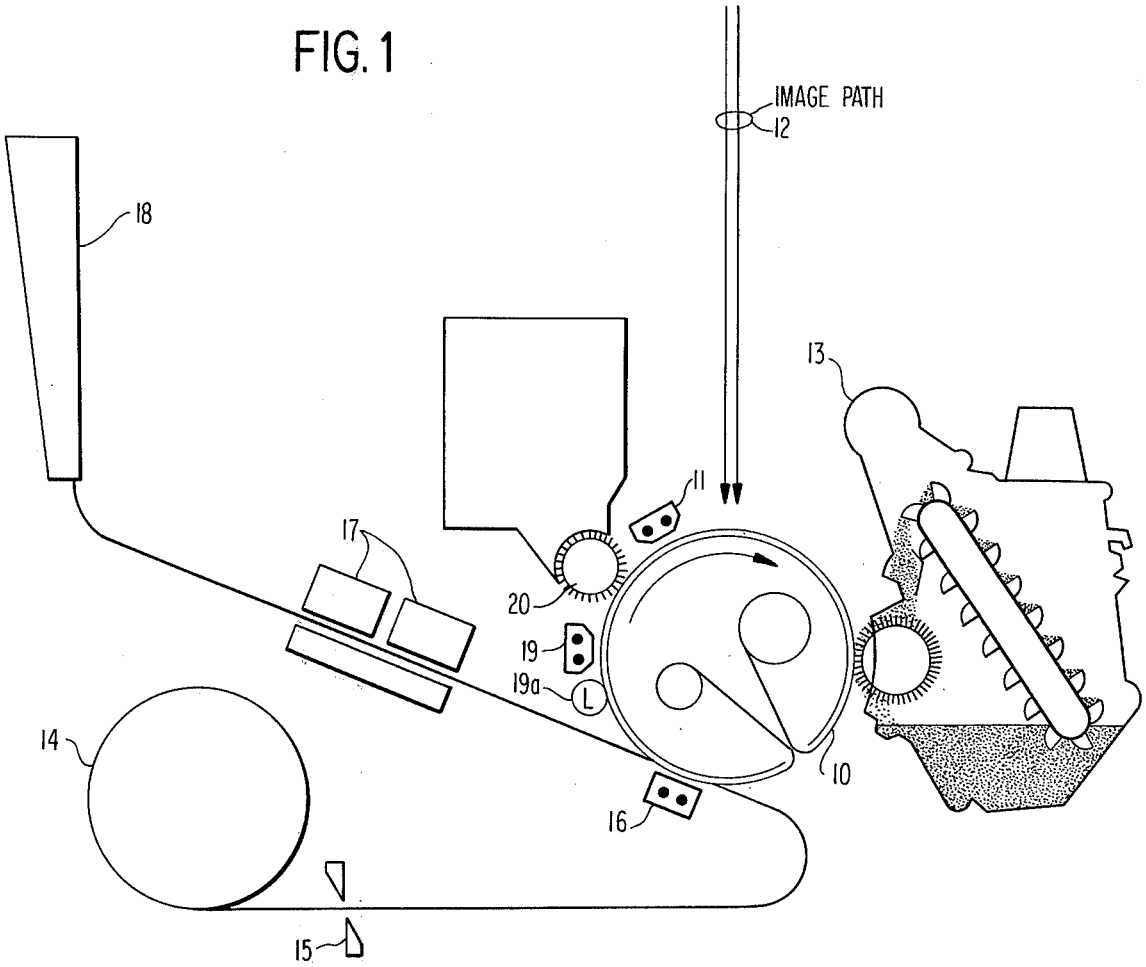
FIG. 1 is a schematic showing of the major components of a conventional electrostatic copier with which the invention is designed to be used.

Thus, as shown in FIG. 1, the electrostatic copier includes a rotating cylinder or drum 10 (which is rotated by means not shown) covered by a photoconductor which is supported on a conductive base layer. The copying process begins at the charge corona 11 which is merely a high voltage source designed to place a uniform electrostatic charge on the photoconductor. Once charged, the photoconductor rotates into the image path 12. The charged photoconductor which is exposed to illumination loses its charge and thus the charge remains only in the area of the image. In order to make the image visible, a developer 13 is employed which cascades toner, coated onto a carrier (for example, plastic coated steel balls) past the charged photoconductor. Electrostatic effects cause toner to adhere to the charged areas, thus providing a visible image on the drum surface. A paper roll 14 supplies paper past a knife 15 which serves to cut the paper into suitable lengths. The paper path brings the paper between a transfer corona 16 and the now developed image on the drum surface. The transfer corona serves to attract the toner particles on the photoconductor to the paper. The paper, now coated with toner in the image area, passes to a fuser 17 where the toner is caused to melt and adhere to the paper. The completed product is then transferred to the exit pocket 18 where it is available to the user.

Inasmuch as all of the toner previously adhering to the drum is not removed by the transfer corona, the drum surface then moves past a clean corona 19. The clean corona 19 is similar to the transfer and charge coronas although opposite in polarity, and thus serves to remove any remaining charge on the photoconductor. Any toner remaining on the photoconductor is removed by a cleaning brush 20. Conventionally, an erase lamp **19*a*** is also employed to further remove any residual charge on the photoconductor.

There are a variety of techniques in which the foregoing apparatus can be used to transfer the image from the image path 12 to a carrier, such as a piece of paper. In one technique, an operating cycle is defined comprising one revolution of the drum. In this operating cycle, first the photoconductor is charged by the charge corona 11, the image is transferred first to the drum and then to a carrier by the transfer corona, the drum is then cleaned by the clean corona and cleaning brush. As an alternative to the foregoing, the steps of charging, imaging, applying toner and transferring the image to the carrier can be completed in one cycle of the drum rotation, and on the second cycle of the drum rotation, the drum surface can be cleaned. These and other operating cycles are implemented by a control device which responds to drum rotation as well as operator inputs to energize and de-energize the various components shown in FIG. 1.

Addressing now the invention, the goals of the corona monitoring and alignment are achieved in the following fashion. Corona operation is typically monitored by monitoring the current induced in the conductive layer of the photoconductor as the drum 10 rotates with only a single corona generator energized.

Figure 2:
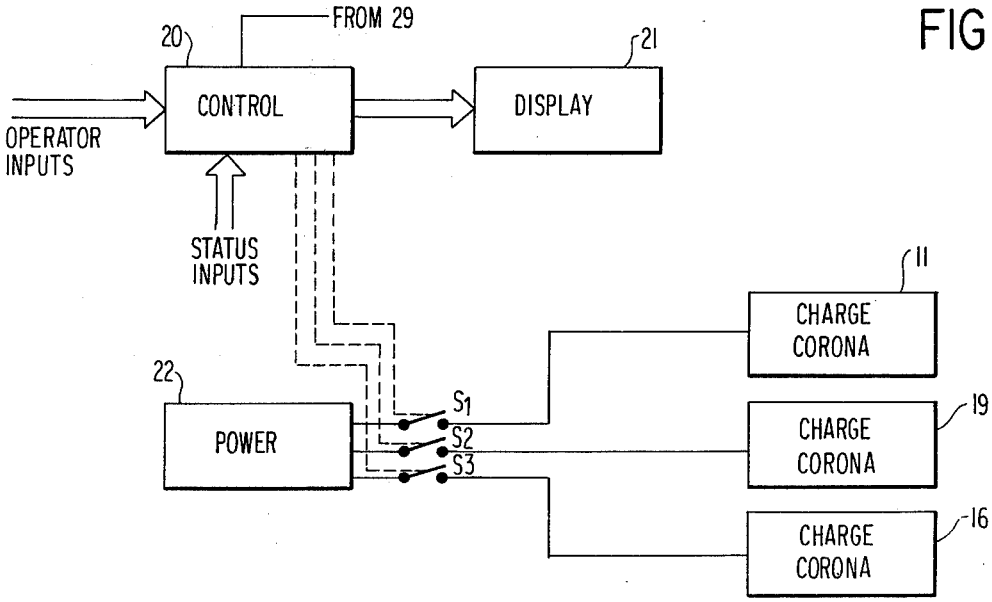
FIG. 2 is a block diagram of the energization path for multiple corona generators in the electrostatic copier and the manner in which they are controlled.

FIG. 2 is a schematic showing of the manner in which the various corona generators are energized. More particularly, a control device 20 receives operator inputs, typically from an external control panel, and also receives status inputs from various elements in the copier. While the control device 20 may perform a number of functions, insofar as it is relevant to the present invention, it may operate a display 21 and control the condition of a plurality of switches S1–S3. The switches S1–S3 control the application of power from a supply 22 to respectively the charge corona 11, clean corona 19, and transfer corona 16. Inasmuch as the illustration of FIG. 2 is schematic, those skilled in the art will understand that it is not meant to imply that a single power supply 22 necessarily supplies the various coronas, nor that the switches S1–S3 are necessarily mechanical switches. Control device 20 may comprise a conventional discrete circuit control system or can be implemented as a microprocessor or mini-computer. Insofar as the control device 20 is relevant to the present invention, its implementation will be understood by those skilled in the art and therefore further disclosure is deemed unnecessary.

In normal operation, the control device 20 closes the switches S1–S3 in order to implement the machine's operating cycle as previously discussed. For operating in accordance with the inventive method, the control device 20 responds to operator inputs, indicating a maintenance mode to energize one or two of the corona generators 11, 19 or 16 by closing the associated switch S1, S2 or S3.

Figure 3:
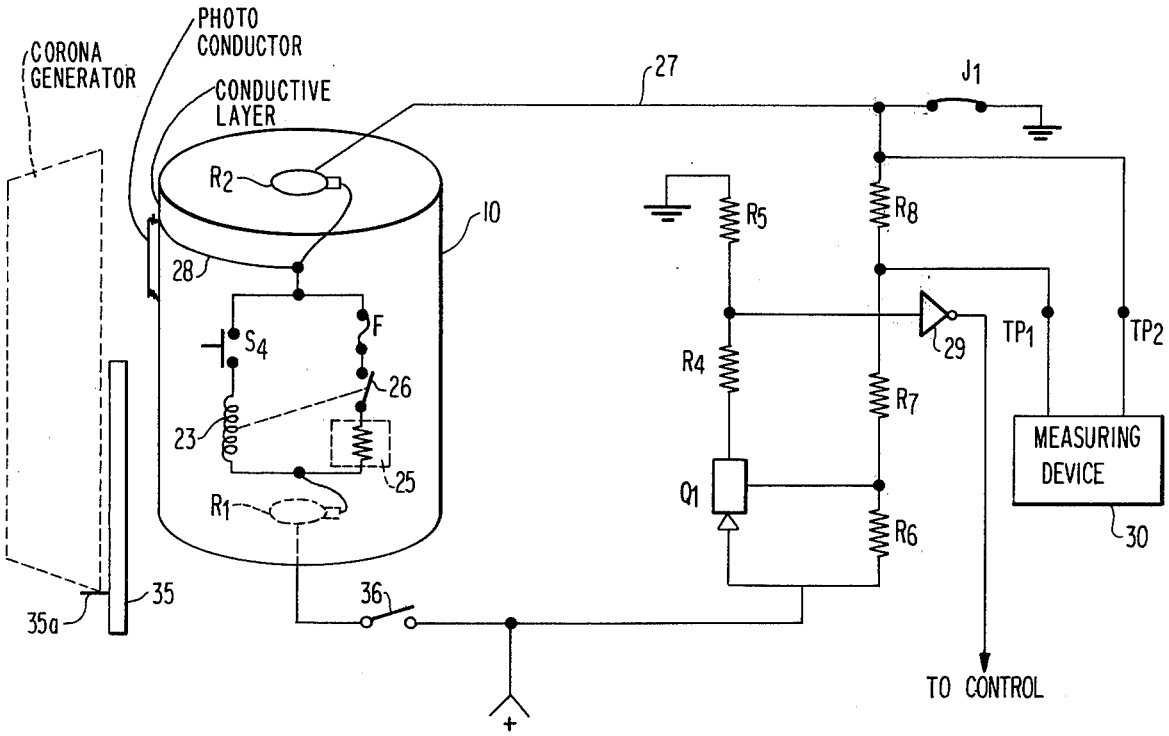
FIG. 3 is a schematic illustrating the measurement apparatus of the invention and the relationship to the drum and a typical corona generator.

FIG. 3 illustrates the apparatus of the invention. The rotatable drum 10 supports a photoconductor on its surface consisting of the photoconductor P on a conductive layer CL. The conductive layer CL is electrically connected, via conductor 28 to a slip ring R2 mounted on the drum support. The slip ring R2 provides a path to ground via conductor 27 and jumper J1. In a practical implementation of the invention, the copier drum 10 also includes a heating circuit comprising a relay coil 23 coupled in series with a temperature control switch S4. Connected in parallel with the coil and the switch are a resistive heating element 25, a contact 26, controlled by the coil 23 and a fuse F. This circuit is coupled to a positive source of potential via a slip ring R1 and relay contact 36, and to ground via the same slip ring R2, conductor 27 and jumper J1. When the copier is in use the coil 23 is de-energized by means of the external relay contact 36 between the positive supply and the drum slip ring R1, and thus the circuit to resistive heating element 25 is open at the contact 36. Thus, the conductive layer CL of the photoconductor P is normally grounded, as illustrated in FIG. 3. The dotted outline C.G. represents a typical corona generator whose operation is to be monitored and which may be aligned in accordance with the teachings of the invention. FIG. 3 also illustrates the measuring circuit which is also connected between the same positive supply and ground. The measuring circuit includes a transistor Q1 having an emitter coupled to the supply and a collector coupled to one terminal of a resistor R4 whose other terminal is connected to one terminal of a resistor R5 whose other terminal is grounded. Also coupled to the positive supply potential and the emitter of transistor Q1 is one terminal of a resistor R6 whose other terminal is coupled to the base of the transistor Q1. The base of the transistor Q1 is also coupled to one terminal of a resistor R7 whose other terminal is coupled to a resistor R8, which, in turn, is coupled to the conductive path 27. Test points TP1 and TP2 are connected across the resistor R8 and a measuring device 30, for example, a voltmeter may be connected to TP1 and TP2 to read the voltage across the resistor R8. The junction of resistors R4 and R5 are coupled as an input to an inverter 29 whose output is coupled to the control 20 (see FIG. 2) for reasons which will be explained hereinafter. Finally, the ground connection from the slip ring R2 includes a jumper J1, or equivalent one pin connector to allow opening of the ground path.

In normal operation, that is, with the jumper J1 inserted, multiple coronas may be simultaneously energized, and regardless of whether or not one or more corona generator is energized, the current generated in the conductive layer CL as the result of one or more coronas, flows directly through the conductor 27 to ground. Current flows through resistors R6, R7 and R8 from the positive supply potential through jumper J1 to ground. The resulting voltage drop across resistor R6 enables transistor Q1 and thus, current flows through transistor Q1, resistors R4 and R5 to ground. The voltage dropped across resistor R5 is coupled through the inverter 29 producing a low output. This is coupled to the control 29 and indicates that the jumper J1 is inserted and the machine is configured for normal operation.

For measurement of the current in the conductive layer CL of the photoconductor P, the jumper J1 is removed. With all corona generators de-energized, current flow through the resistors R6, R7, R8 is prevented. Accordingly, transistor Q1 is rendered nonconductive and current ceases flowing through resistors R4 and R5. The low input voltage to the inverter 29 produces a high output which is interpreted at the control 20 as indicative that the jumper J1 has been removed. Also during the corona current measurement, the current through R6, R7, R8 is relatively small so that transistor Q1 is not rendered conductive.

In order to measure or monitor the operation of a particular corona generator, the motor rotating the drum 10, and the selected corona generator are energized. For example, operator inputs to the control 20, in the maintenance mode, provide for drum rotation and energization of a selected one or ones of the corona generators and energization of the erase lamp and magnetic brush developer bias. Charging of the photoconductor P induces current in the conductive layer CL which, with the jumper J1 removed, flows through the resistor R8 to the positive supply. Note that the conductive layer CL is held at a potential nearly equal to the potential of the positive supply during the measurement process when the jumper J1 is removed. However, this does not perturb corona operation and thus, the current measured because the potential of the positive supply used by the circuit (typically +24 volts) is very small compared to the operating voltages of the corona mechanism. The current flow through resistor R8 produces a voltage which is available at the test points TP1, TP2 for measurement by the measurement device 30. Thus, the measured current is a result of the drum charging by the selected one or ones of the corona generators during drum rotation, effectively simulating actual operation. Energization of the erase lamp **19*a* makes the photoconductor conductive in the illuminated part of the photoconductor to discharge the surface charge. This action does not produce a current flow in the ground path as it is similar to discharging a capacitor with a parallel resistor. This reduces the surface charge on the photoconductor to inhibit development of toner on the drum. This also provides the photoconductor in a discharged state as it passes the selected generator, an action similar to actual operation. It should be noted that typically the apparatus shown in FIGS. 2 and 3 are included in the copier, except that the measuring device 30** need not be included, but can be connected as illustrated for measurement purposes only.

In order to employ the apparatus illustrated in FIGS. 2 and 3, the method of the invention includes the following steps:

In the first instance, the operator input to the control 20 indicates that normal operation is terminated and a testing mode will be entered, allowing drum rotation and selective energization of the corona generators; next, the jumper J1 is removed. The control 20 response to other commands or to an indication that the jumper J1 has been removed and/or a further operator input indicating the particular corona generator to be operated (the charge corona, clean corona or transfer corona) by turning on the motor rotating the drum 10, energizing the selected corona as well as the magnetic brush and the erase lamps. In this configuration, the current carried by the conductive layer CL of the photoconductor P can be measured. By selectively energizing each of the coronas, the currents generated by each corona can be measured. When the procedure is completed, the jumper J1 is re-inserted. If desired, this can be used by the control 20 as a signal that the measurement mode has been terminated and responsively the control 20 can, for example, turn off the motor, magnetic brush, erase lamps and previously selected corona generator.

When using the foregoing method with the charge or transfer coronas energized, for example, a dynamic measurement of the charging current is available. More particularly, each of these coronas negatively charges the photoconductor, and it is the charging process which generates the current which is measured. As the now-charged area of the photoconductor rotates under the erase lamp, the illumination drains the charge off, and the area is again available in a relatively uncharged state. In this fashion, the current measured corresponds to operation of the machine in its dynamic mode which is, of course, normal mode of operation.

The foregoing operation is, however, limited to negative coronas and is not true of the clean corona (a positive corona). The clean corona 19 produces a positive charge on the photoconductor P. This positive charge is not drained by the erase lamp and thus without modifying the technique, the charge in the photoconductor would merely build up and would not be representative of typical machine operation. The foregoing method is therefore modified for a positive corona. Whenever the clean corona (or any other positive corona) is energized, a corresponding negative corona is also energized, either simultaneously or on alternate cycles. For example, the clean and transfer coronas can be energized simultaneously. While the resulting current produced in the conductive layer CL by this operation is not representative of the current caused by the clean corona alone, it will be an accurate measure of the operation of the clean corona when the effect of the negative corona is removed and is moreover in accordance with the dynamic operation which occurs within the copier during its normal operation. That is, for example, if the clean corona is entirely inoperative and produces no positive charge on the photoconductor, the current induced in the conductive layer CL will be entirely due to the transfer corona. Measurement of this current will make it readily apparent that the clean corona is inoperative. In like fashion, if the clean corona is operating either above or below nominal levels, the current measurement will reveal the situation. Thus, typically, measurement of the negative coronas is effected first, allowing the positive current to be inferred from a measurement by subtracting the previously measured negative current.

In another modification, the clean corona is energized for one drum rotation and is followed by a few cycles of a negative corona whereafter the cycle may be repeated.

Corona alignment employs the foregoing method and actually employs two different measurements. In order to get a measurement of corona alignment, a first measurement is made with a given area of the corona masked such that the photoconductor charging is due solely to the unmasked portion of the corona generator. The mask 35 (see FIG. 3) represents such a masking operation. The mask 35 may comprise paper held or taped to the housing of the corona generator. Alternatively, the mask 35 may be any other non-conductive material which can be fixed relative to the housing. Under these circumstances, the current measured represents the effect of the unmasked portion of the corona generator. A second measurement is effected masking a different area of the corona generator. For example, the two areas masked may be equal.

This can be accomplished, for example, by using the stop 35*a* and positioning it against each edge of the corona housing. A corona generator which is properly aligned will result in relatively equal currents being measured during the two measurements. Misalignment is indicated by an inequality of the measured current and the direction of misalignment is indicated by the relative magnitudes of the current measured.

Many modifications can be made to the apparatus and methods disclosed herein within the spirit and scope of the invention. For example, the circuit including R4, R5, R6, R7, Q1 and inverter 29 is merely optional to check on the condition of jumper J. If this is not believed necessary, it can be eliminated and TP1 can be connected to ground or other low potential. Similarly, if the measurement device is in the circuit, the resistor R8 can be eliminated. For those embodiments with a low voltage drop (about 0.5 volts) across the measurement device the resistor R8 can be replaced by a back biased diode, or back to back diodes for bipolar operation, so that all the measured current flows through the measurement device.

In addition, if a ground path to conductive bearings can be interrupted for measurements, the slip rings need not be used for drum current, and instead conductive bearings may be used.

What is claimed is:

1. A method of corona alignment for aligning corona in situ in an electrostatic copier which copier includes at least one corona generator, a rotatable image bearing drum with a photoconductor supported on a conductive layer comprising the steps of:

energizing a selected corona generator, interrupting a normal current return path from said conductive layer, providing a current path from said conductive layer, coupling said current path to a measurement device, masking a selected area of said selected corona generator, measuring current in said current path with said generator masked, subsequent to said measuring step, unmasking said selected area and masking a different area, and again measuring current in said current path with said different area masked.

2. The method of claim 1 which includes the additional step of continuously rotating said drum throughout said measurement steps.

3. The method of claim 1 wherein said copier includes an erase lamp and wherein said method includes the step of energizing said erase lamp throughout said measurement steps.

4. The method of claim 3 in which said copier includes at least one corona of a first polarity and at least one corona of a second polarity comprising the further steps of energizing at least one corona of said second polarity if said corona of said first polarity is energized.

5. The method of claim 4 in which said coronas of first and second polarity are simultaneously energized.

6. The method of claim 4 in which said coronas of first and second polarity are energized in alternate and sequential time periods.

7. A method of corona current measurement in situ in an electrostatic copier with plural corona generators, and including at least two corona generators of opposite polarity, an erase lamp, a rotating electrostatic image bearing means supported on a conductive layer and a current return path coupled to said conductive layer and ground, comprising the steps of:

rotating said image bearing means and energizing said erase lamp, selectively energizing less than all said plurality of corona generators, but simultaneously energizing at least said two corona generators of opposite polarity, uncoupling said current return path, providing a current path from said conductive layer to a measurement device, and measuring current in said current path.

8. A method of corona current measurement in situ in an electrostatic copier with plural corona generators, and including corona generators of opposite polarity, an erase lamp, a rotating electrostatic image bearing means supported on a conductive layer and a current return path coupled to said conductive layer and ground, comprising the steps of:

rotating said image bearing means and energizing said erase lamp, selectively energizing less than all said plurality of corona generators, but simultaneously energizing corona generators of opposite polarity in alternate and sequential time periods, uncoupling said current return path, providing a current path from said conductive layer to a measurement device, and measuring current in said current path.

9. Corona measurement apparatus for corona measurement in situ in an electrostatic copier which includes:

a rotating electrostatic image bearing means with a photoconductor supported on a conductive layer, a current return path coupled between said conductive layer and ground, a plurality of simultaneously operating corona generators, each located adjacent said image bearing means to charge said photoconductor as said image bearing means rotates, including at least first and second corona generators of first and second polarities, respectively, wherein the improvement comprises:

means to selectively energize less than said plurality of corona generators including means to energize a single corona generator unless said single generator is of a first polarity, in which case, a corona generator of a second polarity is also energized, uncoupling means for interrupting said current return path, and measurement current path means coupled to said conductive layer for carrying current from said conductive layer only when said current return path is interrupted and including means for coupling said path means to a measurement device.

10. The apparatus of claim 9 wherein said means to selectively energize simultaneously energizes corona generators of first and second polarity.

11. The apparatus of claim 9 wherein said means to selectively energize, energizes said first and second corona generators in alternate and sequential time periods.

12. Corona measurement apparatus for a corona measurement in situ in an electrostatic copier which includes:

a rotating electrostatic image bearing means with a photoconductor supported on a conductive layer, a current return path coupled between ground and said conductive layer, a plurality of normally simultaneously operating corona generators, located adjacent said image bearing means, wherein the improvement comprises means to condition said copier for a measurement, and to terminate normal operation of said copier, including means to energize less than all said corona generators, and uncoupling means for interrupting said current return path including a manually operable circuit making or breaking device located in said current return path, and measurement current path means coupled to said conductive layer for carrying current from said conductive layer only when said current path is interrupted, said measurement current path means including means for coupling said path means, to a measurement device, whereby, during normal operation, said conductive layer is grounded through said current return path, and in said measurement mode, current from said conductive layer flows through said measurement current path rather than said current return path.

13. The apparatus of claim 11 in which said rotating electrostatic image bearing means comprises a cylindrical drum supporting said photoconductor and conductive layer.

14. The apparatus of claim 13 in which said rotating electrostatic image bearing means is supported on an insulated bearing.

15. The apparatus of claim 11 in which said means to selectively energize, energizes only a single one of said corona generators.

* * * * *

UNITED STATES PATENT AND TRADEMARK OFFICE

CERTIFICATE OF CORRECTION

PATENT NO. : 4,189,642

DATED : February 19, 1980

INVENTOR(S) : D.J. Justus et al

It is certified that error appears in the above—identified patent and that said Letters Patent is hereby corrected as shown below:

Column 9, line 48, after "single" (second occurrence) insert -- corona --.

Column 10, line 42, "11" should read -- 12 --.

Column 10, line 49, "11" should read -- 12 --.

Signed and Sealed this

*Nineteenth* Day of *August 1980*

[SEAL]

*Attest:*

SIDNEY A. DIAMOND

*Attesting Officer*

*Commissioner of Patents and Trademarks*